US005488265A

United States Patent [19]

Chen

[11] Patent Number: 5,488,265

[45] Date of Patent: Jan. 30, 1996

[54] ELECTRON GUN WITH CHAIN-LINK MAIN LENS FOR STATIC CORRECTION OF ELECTRON BEAM ASTIGMATISM

[75] Inventor: Hsing-Yao Chen, Barrington, Ill.

[73] Assignee: Chunghwa Picture Tubes, Ltd., Taoyuan, Taiwan

[21] Appl. No.: 511,722

[22] Filed: Aug. 7, 1995

Related U.S. Application Data

[63] Continuation of Ser. No. 140,311, Oct. 22, 1993, abandoned.

[51] Int. Cl.[6] ..... H01J 29/50

[52] U.S. Cl. ..... 313/414; 313/412; 313/447

[58] Field of Search ..... 313/412, 414, 313/447; 445/34

[56] References Cited

U.S. PATENT DOCUMENTS

| | | | |
|---|---|---|---|
| 4,169,239 | 9/1979 | Ehata et al. | 313/460 |
| 4,400,649 | 8/1983 | Chen | 313/414 |
| 4,520,292 | 5/1985 | Hekken et al. | 313/412 |
| 4,764,704 | 8/1988 | New et al. | 313/414 |
| 4,800,318 | 1/1989 | Naiki | 313/414 |
| 5,027,043 | 6/1991 | Chen et al. | 315/368 |
| 5,036,258 | 7/1991 | Chen et al. | 315/382 |
| 5,043,625 | 8/1991 | Chen | 313/414 |
| 5,055,749 | 10/1991 | Chen et al. | 315/368 R |
| 5,091,673 | 2/1992 | Shimoma et al. | 313/412 |
| 5,146,133 | 9/1992 | Shirai et al. | 313/414 |
| 5,164,640 | 11/1992 | Son et al. | 315/382 |
| 5,170,101 | 12/1992 | Gorski et al. | 315/368.11 |
| 5,196,762 | 3/1993 | Go | 313/414 |
| 5,202,604 | 4/1993 | Kweon | 313/414 |
| 5,212,423 | 5/1993 | Noguchi et al. | 313/414 |
| 5,241,240 | 8/1993 | Chen et al. | 313/414 |

*Primary Examiner*—Donald J. Yusko
*Assistant Examiner*—Michael Day
*Attorney, Agent, or Firm*—Emrich & Dithmar

[57] ABSTRACT

An inline electron gun for use in a multi-beam color cathode ray tube (CRT) has a main focus lens for focusing the electron beams on a display screen of the CRT. The main focus lens includes adjacent charged electrodes each having a respective common lens aperture through which the electron beams are directed and which are in facing relation for reducing horizontal spherical aberration of the electron beams on the display screen, where each common lens aperture has a longitudinal axis aligned with the inline electron beams. In one embodiment, each common lens aperture is chain-link-shaped including spaced, vertically enlarged portions, each aligned with a respective electron beam for correcting for vertical spherical aberration. Each adjacent electrode further includes a plurality of auxiliary apertures, each aligned with and passing a respective electron beam. Each auxiliary aperture includes a generally circular center portion and upper and lower slots extending generally vertically therefrom to provide balanced focusing for all of the electron beams as well as to correct for beam astigmatism. The circular center portion of each aperture is adapted to receive a cylindrical electrode support rod, or mandrel, disposed within and aligning the electrodes during electron gun assembly. The three inline auxiliary apertures may have the same diameter, or the two outer apertures may have larger diameters and wider slots than the center aperture in another embodiment. The slots may be vertically centered on the circular center portion of each aperture, or the two outer apertures may have outwardly disposed upper and lower slots in another embodiment.

20 Claims, 8 Drawing Sheets

ELECTRON GUN WITH CHAIN-LINK MAIN LENS FOR STATIC CORRECTION OF ELECTRON BEAM ASTIGMATISM

This is a continuation of application Ser. No. 08/140,311, filed Oct. 22, 1993, now abandoned.

FIELD OF THE INVENTION

This invention relates generally to multi-electron beam color cathode ray tubes (CRTs) and is particularly directed to an inline electron gun and a focus electrode therefor having a common lens aperture and a plurality of auxiliary inline beam passing apertures which are configured to facilitate electron gun assembly while providing beam asymmetric aberration and defocusing correction.

BACKGROUND OF THE INVENTION

The most commonly used multi-beam electron guns employed in color CRTs direct three inline electron beams on the inner surface of the CRT's faceplate. A magnetic deflection yoke disposed outside of the CRT's glass envelope sweeps the three electron beams in unison across the faceplate in a raster-like manner. The three electron beams are aligned generally horizontally, or in the direction of each sweep across the CRT's faceplate.

Over the past several years, design of high resolution color CRT electron guns has evolved from the individual type of main lens design to the common lens type design. In the individual type main lens design, inside each of the three guns (red, blue, green) the electron beam goes through an individually defined lens space without sharing this space with the other beams. While this type of electron gun is simple and straightforward, it suffers from the limitation that each gun has a very limited space, resulting in high spherical aberration and generally poor electron beam spot resolution at high beam current.

The so-called "common lens" design has a single, shared aperture for the three electron beams. Each of the three beams goes through its own individual beam path, plus a shared focusing region. The common lens design dramatically reduces spherical aberration in the horizontal direction and also somewhat reduces spherical aberration in the vertical direction. Referring to FIG. 1, there is shown a longitudinal sectional view of a prior art color CRT 20. CRT 20 includes a three beam inline electron gun 21 having three cathodes 32, 34 and 36 for generating three groups of energetic electrons and directing the electrons through three apertures in a $G_1$ control electrode 38, or grid as these charged elements are sometimes referred to. Electron gun 21 further includes a $G_2$ screen electrode 40 which similarly includes three inline apertures, each aligned with a respective aperture in the $G_1$ control electrode 38. The $G_1$ control electrode 38, the $G_2$ screen electrode 40 and a facing portion of a $G_3$ electrode 42 define a beam forming region (BFR) of electron gun 21. Electron gun 21 further includes a high voltage focusing region comprised of the $G_3$ electrode 42 and a $G_4$ electrode 44. The three inline apertures of each of the aforementioned electrodes are aligned with a respective one of the cathodes 32, 34 and 36 so as to define three center axes 50, 52 and 54. A convergence cup 46 is attached to the high side of the $G_4$ electrode 44 for supporting the electron gun 21 within the neck portion of the CRT's glass envelope 22 and for connecting the $G_4$ electrode 44 to an anode voltage source (not shown) by means of a conductive film 30 disposed on the inner surface of the funnel portion of the glass envelope. The three electron beams are swept in unison across the inner surface of the CRT's display screen 24 by means of a magnetic deflection yoke 48. Disposed on the inner surface of the display screen 24 is a phosphor layer 26 which emits the three primary colors of red, green and blue when the three electron beams are incident thereon. A charged shadow mask 28 disposed adjacent to the CRT's display screen 24 and including a large number of apertures for passing the electron beams serves as a color selection electrode in permitting each electron beam to be incident upon selected areas of the phosphor layer 26.

A second generation of electron guns incorporating a common lens employs an auxiliary asymmetric lens within a focusing electrode to correct for asymmetric electron beam spots 62 on the CRT's display screen as shown in FIG. 2. This auxiliary asymmetric lens typically employs non-circular beam passing apertures which are shaped to correct for the asymmetric lens effect and more particularly to provide beam asymmetric aberration and defocusing correction and a more nearly circular electron beam spot on the CRT's display screen. However, the non-circular shape of the auxiliary lens beam passing apertures renders it more difficult to align the various electrodes during electron gun assembly.

The prior art includes various common lens and auxiliary asymmetric lens combinations which correct for beam defocusing and astigmatism in a multi-beam inline electron gun. One such approach is disclosed in U.S. Pat. No. 5,146,133, issued Sep. 8, 1992, employing facing common lens portions in the horizontally elongated $G_3$ and $G_4$ electrodes 42 and 44 as shown in the partially cutaway perspective view of FIG. 3. The facing common apertures of the $G_3$ and $G_4$ electrodes permit the electric field of the opposed electrodes to penetrate well into the plate electrodes 70 and 72. The lens converging force in the horizontal direction is thus weaker than that in the vertical direction resulting in electron beam astigmatism. In order to correct for astigmatism, the auxiliary aperture is formed in a non-circular shape with the aperture diameter in the horizontal direction smaller than that in the vertical direction. This is shown in FIG. 4 which is an end-on view of the $G_4$ electrode 44. The $G_4$ electrode 44 includes a cylindrical electrode having opposed arcuate portions **68*a* with radii $R_1$ and opposed upper and lower straight line portions 68*b*. The points corresponding to the center axes of the three inline cathodes of electron gun are represented as points O, P and Q in FIG. 4, which respectively lie along vertical lines 74, 76 and 78. The $G_4$ electrode 44 further includes the aforementioned generally flat plate electrode 72 disposed within the cylindrical electrode 68 and including a vertically elongated aperture 75. Respective ends of the plate electrode 72 are provided with curvilinear edges 72*a*. In assembling the electron gun, a core bar jig 80 (also known as an electrode support rod or mandrel) is inserted between the electrode's horizontally elongated electrode 68 and the plate electrode 72 as shown in FIG. 5. The core bar jig 80 receives the straight line portion 68*b* of the $G_4$ electrode 44 during assembly of the electron gun to ensure proper electrode alignment and electron gun concentricity. From FIG. 5, it can be seen that the core bar jig 80 has a non-round outer circumference which distinguishes it from the round beam passing apertures in the remaining portions of the $G_3$ and $G_4$ electrodes. The non-circular cross sectional shape of the core bar jig 80** renders it more costly to produce and more difficult to precisely align the electrodes during electron gun assembly.

The present invention addresses the aforementioned limitations of the prior art by providing a main lens design having common apertures in facing relation in two adjacent electrodes of an electron gun for passing three inline electron beams. The main lens electrodes each further include three inline auxiliary beam passing apertures each shaped to facilitate electron gun assembly using conventional round mandrel beading techniques while providing beam asymmetric aberration and defocusing correction.

OBJECTS AND SUMMARY OF THE INVENTION

Accordingly, it is an object of the present invention to provide a charged electrode arrangement for a multi-beam electron gun for use in a color CRT which facilitates precise alignment of the electron gun's electrodes during assembly to provide a high quality video image.

It is another object of the present invention to correct for electron beam astigmatism and provide balanced focus in a multi-beam inline electron gun particularly at high electron beam currents such as above approximately 2–3 mA.

A further object of the present invention is to facilitate assembly of a multi-beam electron gun using a cylindrical mandrel for supporting the electron gun's electrodes in alignment during assembly and ensuring a high degree of electron gun concentricity.

These objects of the present invention are achieved and the disadvantages of the prior art are minimized by an electrode in an electron gun for directing a center and two outer inline electron beams along respective parallel axes onto a display screen of a color cathode ray tube (CRT) in forming a video image on the screen, the electrode comprising: a hollow housing open at a first end and having three inline end apertures at a second opposed end and a thin lateral wall forming side portions of the housing, wherein each of the inline end apertures is aligned with a respective one of the axes for passing a respective one of the beams, and wherein the first open end includes a single aperture having a longitudinal axis aligned with the center and outer inline electron beams for passing the center and two outer electron beams; means disposed in the hollow housing for defining circular portions of three inline auxiliary apertures disposed intermediate the first and second ends of the housing, wherein each of the auxiliary apertures is aligned with a respective one of the axes for passing a respective one of the beams, and wherein the circular portions of each of the auxiliary apertures are adapted to receive in tight-fitting engagement an elongated support rod having a generally circular cross section for aligning the electrode during electron gun assembly; and upper and lower pairs of slots disposed in each of the auxiliary apertures and aligned generally transverse to the longitudinal axis for correcting for electron beam astigmatism.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
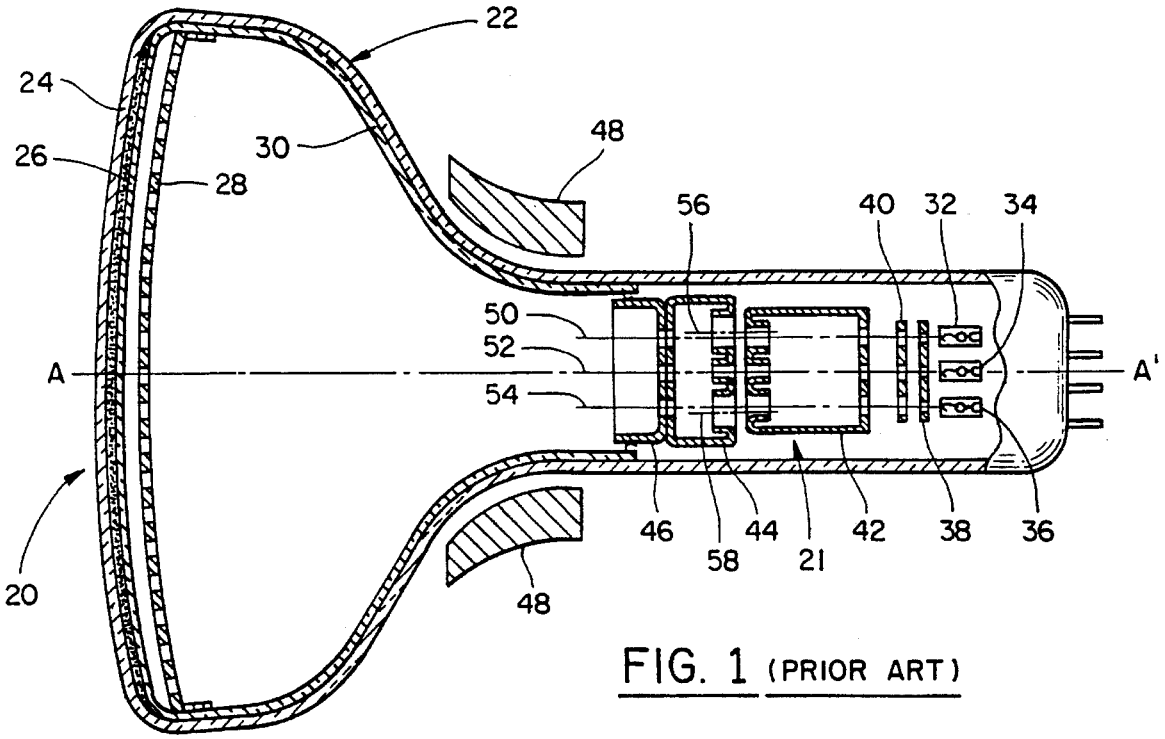
FIG. 1 (PRIOR ART)
FIG. 1 is a longitudinal sectional view of a prior art color CRT including an inline electron gun.
Figure 3:
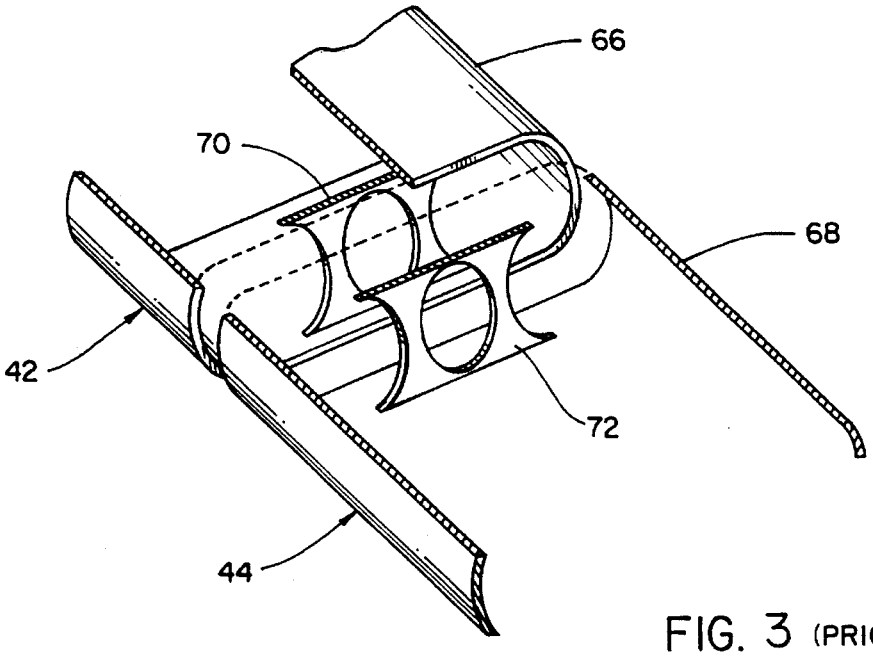
FIG. 3 (PRIOR ART)
FIG. 3 is a partially cutaway perspective view of the $G_3$ and $G_4$ electrodes of another prior art electron gun.
Figure 4:
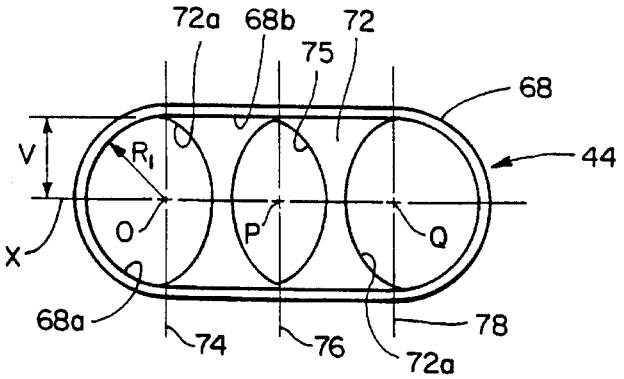
FIG. 4 (PRIOR ART)
FIG. 4 is an end-on elevation view of the $G_4$ electrode shown in FIG. 3.
Figure 5:
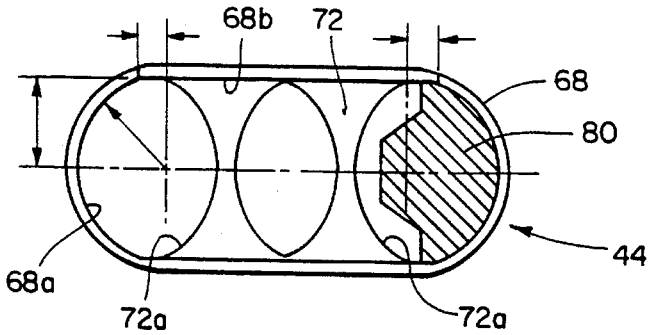
FIG. 5 (PRIOR ART)
FIG. 5 is an end-on view of the $G_4$ electrode of FIG. 4 showing a core bar jig inserted in one of the beam passing apertures of the electrode for aligning the electrode with other electrodes in the electron gun during electron gun assembly.
Figure 2:
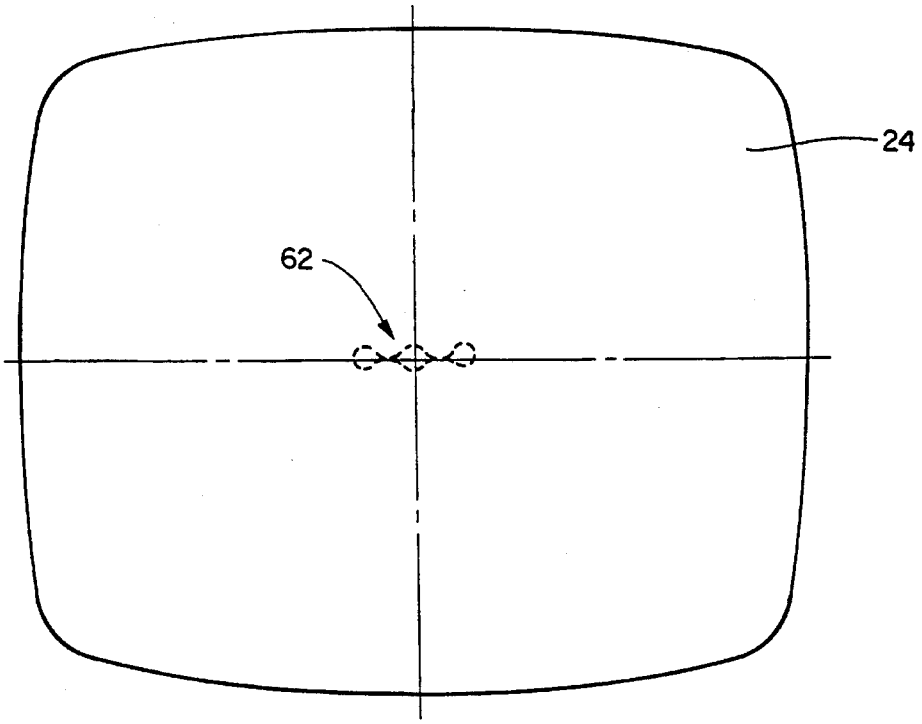
FIG. 2 (PRIOR ART)
FIG. 2 is an elevation view of the display screen of the prior art common lens gun CRT of FIG. 1 illustrating distortion of three electron beam spots at the center of the display screen.
Figure 6:
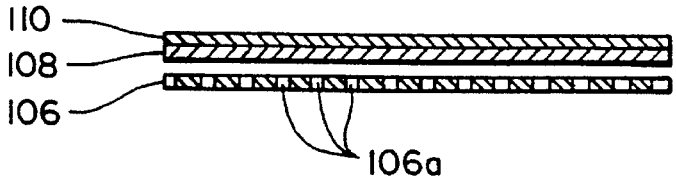
FIG. 6 is a longitudinal sectional view of a bipotential electron gun in accordance with one embodiment of the present invention.
Figure 6:
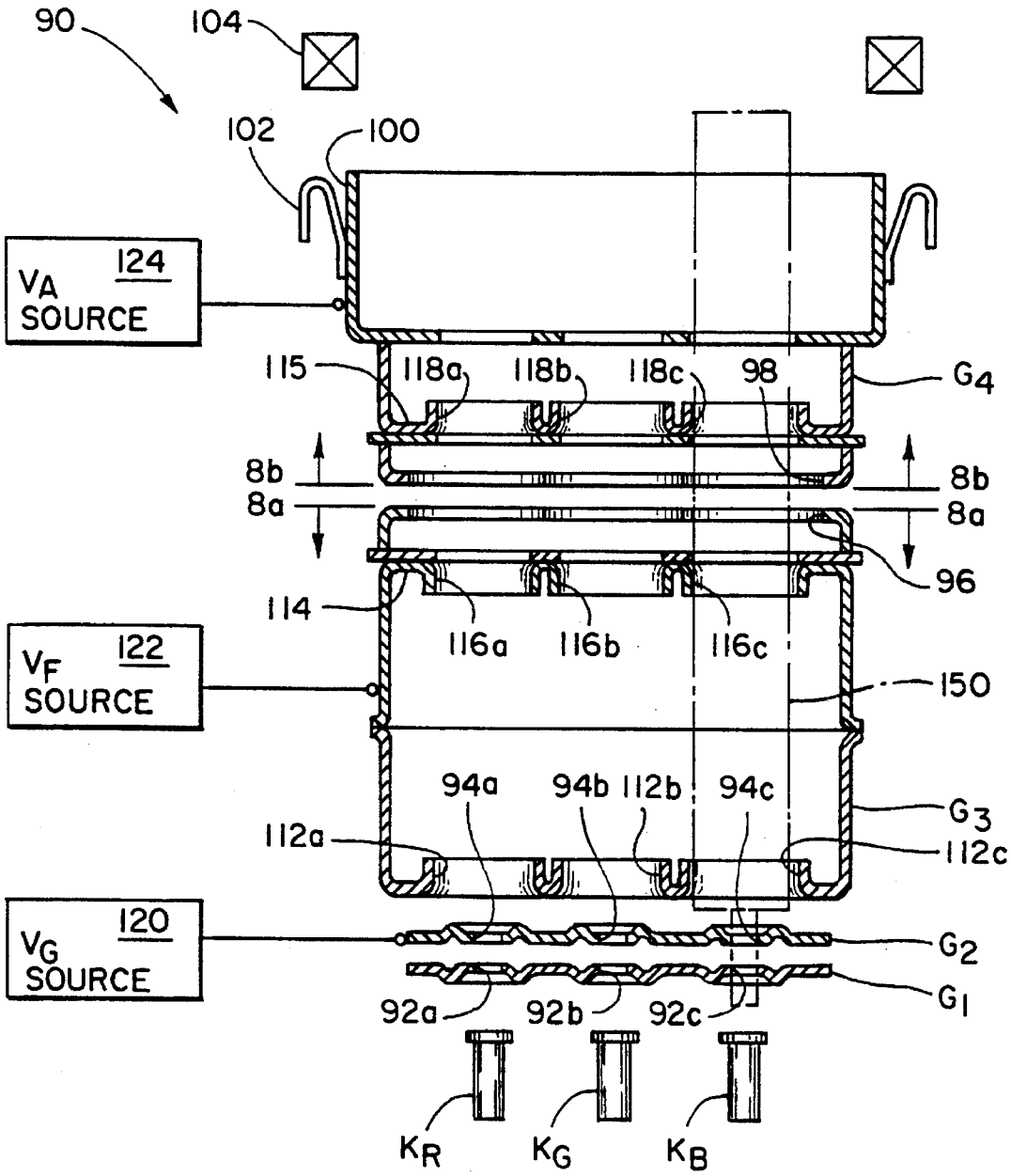

Referring to FIG. 6, there is shown a simplified longitudinal sectional view of an inline electron gun 90 in accordance with one embodiment of the present invention. The present invention is particularly adapted for astigmatism and defocusing correction in a combined optimum tube and yoke (COTY) CRT. A COTY-type CRT employs an inline electron gun and allows the three electron guns to have a larger vertical lens while sharing the horizontal open space in the main lens for improved electron beam spot size. In FIG. 6 and subsequent figures discussed below, common elements in the several disclosed embodiments of the invention performing essentially the same function are identified by the same element number throughout these figures.

The inline electron gun 90 of FIG. 6 is of the bipotential type and includes an electron beam source typically comprised of three cathodes: $K_R$ (red), $K_G$ (green) and $K_B$ (blue). Each cathode is typically comprised of a sleeve, a heater coil and an emissive layer (none of which are shown in FIG. 6 for simplicity), from which emitted electrons are focused to a crossover along the axis of the beam by the effect of an electrode commonly referred to as the $G_2$ screen electrode. An electrode known as the $G_1$ control electrode is disposed between the cathodes and the $G_2$ screen electrode and is operated at a negative potential relative to the cathodes and serves to control the intensity of the electron beams in response to the application of a video signal thereto, or to the cathodes. The $G_2$ electrode is coupled to and charged by a $V_G$ source 120. The aforementioned electron beams' first crossover is at that point where the electrons pass through a beam axis and is typically in the vicinity of the $G_2$ screen electrode. Each of the $G_1$ control and $G_2$ screen electrodes includes three aligned apertures, with corresponding apertures in each electrode in common alignment for passing a respective one of the red, green or blue color generating electron beams. Thus, the $G_1$ control electrode includes electron beam passing apertures 92*a*, 92*b* and 92*c*, while the $G_2$ screen electrode includes electron beam passing apertures 94*a*, 94*b* and 94*c*.

Figure 8A:
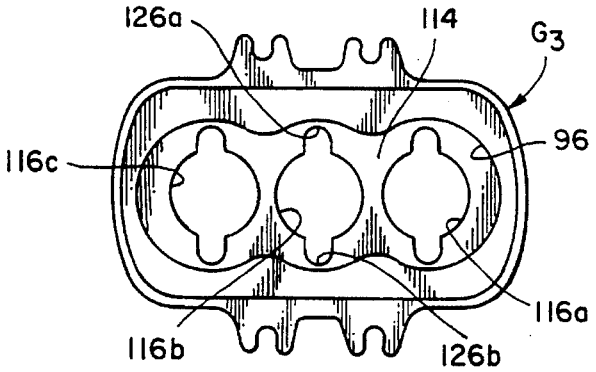
FIGS. 8*a* and 8*b* are sectional views of the electron gun shown in FIG. 6 respectively taken along site lines 8*a*—8*a* and 8*b*—8*b* therein.
Figure 8B:
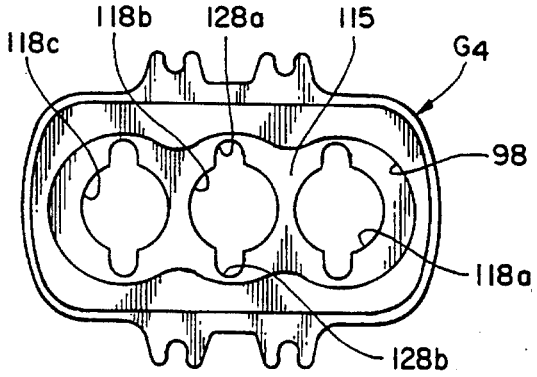

Electron gun 90 further includes a $G_3$ electrode and a $G_4$ electrode disposed about the three electron beams and along the path of the energetic electrons as they travel toward a display screen 110 of a CRT. FIGS. 8*a* and 8*b* are sectional views of the electron gun 90 of FIG. 6 respectively taken along site lines 8*a*—8*a* and 8*b*—8*b* therein and illustrating the $G_4$-facing end of the $G_3$ electrode and the $G_3$-facing end of the $G_4$ electrode, respectively. The $G_3$ and $G_4$ electrodes are each coupled to a voltage source which may be of either the focusing or accelerating type. Thus, as shown in FIG. 6, the $G_3$ electrode is coupled to a focus voltage ($V_F$) source 122, while the $G_4$ electrode is coupled to an accelerating (or anode) voltage ($V_A$) source 124. The $G_3$ and $G_4$ electrodes form what is generally termed the "main lens" of electron gun 90. Attached to the $G_4$ electrode is a conductive support, or convergence, cup 100 which includes a plurality of spaced bulb spacers 102 disposed about the circumference thereof. The support cup 100 and bulb spacer 102 combination is conventional and serves to securely maintain electron gun 90 in position in the neck portion of the CRT's glass envelope which is not shown in the figures for simplicity. Each of the aforementioned electrodes is coupled to and supported by glass beads (also not shown for simplicity) disposed in the glass envelope's neck portion.

After being subjected to the electrostatic fields produced by the accelerating and focusing voltages applied by the aforementioned electrodes, the focused electron beams are then directed through a magnetic deflection yoke 104 which is typically of the self-converging type, for deflecting the electron beams in a raster-like manner across a phosphor coating, or layer, 108 on the inner surface of the CRT's display screen, or glass faceplate, 110. Disposed adjacent to the inner surface of the CRT's screen 110 is a shadow mask 106 having a large number of apertures 106*a* therein. Shadow mask 106 serves as a color selection electrode for producing selective energization of predetermined phosphor elements within the phosphor coating 108 by each of the respective electron beams. The accelerating voltage of $V_A$ is substantially higher than the focus voltage $V_F$ and serves to cooperate with $V_F$ in the electron gun 90 to focus and accelerate the electrons toward the phosphor coated display screen 110. $V_A$ is typically on the order of three or four times the magnitude of $V_F$, where $V_A$ generally has a value on the order of 30 kV and $V_F$ is on the order of 7–9 kV.

As shown in FIG. 6 as well as in the sectional views of FIGS. 8*a* and 8*b*, which are respectively taken along site lines 8*a*—8*a* and 8*b*—8*b* in FIG. 6, each of the $G_3$ and $G_4$ electrodes has a respective elongated common aperture 96 and 98 in facing relation to the other electrode, which electrode combination forms the main focus lens of electron gun 90. The facing portions of the $G_3$ and $G_4$ electrodes are each commonly referred to as the common lens portion of the electrode because all three electron beams transit the single elongated, chain-link-shaped apertures 96 and 98 respectively in the $G_3$ and $G_4$ electrodes. The elongated, chain-link-shaped apertures 96, 98 respectively in the $G_3$ and $G_4$ electrodes provide an increased lens diameter for the three electron beams in the horizontal dimension (in the plane of FIG. 6) to allow for reduction in the horizontal dimension of each of the three electron beam spot sizes on the display screen's phosphor coating 108. Vertical spherical aberration correction is also provided by the hollow common lens electrode combination, particularly for the two outer electron beams. Spherical aberration reduction in the three electron beams reduces each of their spot sizes on display screen 110 without diminishing other performance parameters of electron gun 90. The use of facing main focus electrodes in a COTY-type CRT incorporating facing elongated, chain-link-shaped apertures in adjacent hollow common lens electrodes improves video image resolution by reducing electron beam spherical aberration. This aspect of the present invention is disclosed and claimed in co-pending application, Ser. No. 890,836, filed Jun. 1, 1992, and assigned to the assignee of the present application, the disclosure of which is incorporated by reference in the present application. While the facing common apertures 96, 98 are described herein as generally chain-link in shape, the present invention is not limited to this common aperture configuration, but will operate with virtually any horizontally elongated common aperture shape.

Respectively aligned with the three apertures 94*a*, 94*b* and 94*c* in the $G_2$ electrode and in facing relation with the $G_2$ electrode are three inline apertures 112*a*, 112*b* and 112*c* in the $G_3$ electrode. The $G_3$ electrode further includes three inline auxiliary apertures 116*a*, 116*b* and 116*c* disposed in an inner wall or panel 114 therein. Each pair of aligned end and auxiliary apertures in the $G_3$ electrode pass a respective electron beam. Thus, aligned apertures 112*a* and 116*a* pass the red electron beam, aligned apertures 112*b* and 116*b* pass the green electron beam and aligned apertures 112*c* and 116*c* pass the blue electron beam. As the three electron beams exit the $G_3$ electrode through a common aperture 96, they pass through the $G_4$ electrode's common aperture 98 and thence through a respective one of the auxiliary apertures 118*a*, 118*b* and 118*c* within the $G_4$ electrode. Corresponding inline apertures are disposed in the convergence cup 100 for passing the three electron beams. The $G_4$ electrode's auxiliary apertures 118*a*, 118*b* and 118*c* are disposed in an inner wall 115 of the electrode and are respectively aligned with the auxiliary apertures 116*a*, 116*b* and 116*c* of the $G_3$ electrode for passing a respective electron beam. The $G_3$ and $G_4$ electrodes are each generally in the form of a hollow housing having a thin lateral wall extending around the periphery thereof.

Figure 7:
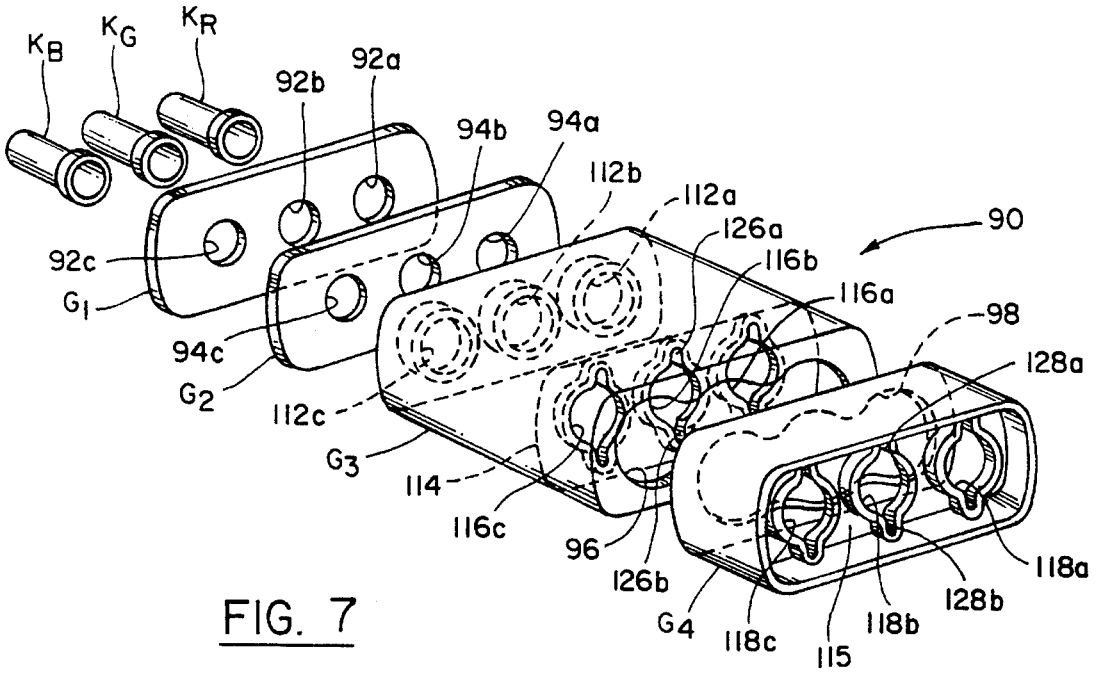
FIG. 7 is a perspective view shown partially in phantom of the bipotential electron gun of FIG. 6.

As shown in FIGS. 6 and 8*a* and 8*b*, and further with reference to the perspective view of the electron gun 90 of FIG. 7, the three auxiliary apertures 116*a*, 116*b* and 116*c* of the $G_3$ electrode and the three auxiliary apertures 118*a*, 118*b* and 118*c* of the $G_4$ electrode are each provided with a pair of opposed upper and lower slots or notches. Thus, as shown for the case of the $G_3$ electrode, its center auxiliary aperture 116*b* is provided with generally vertically extending upper and lower slots 126*a* and 126*b*. The outer two auxiliary apertures 116*a* and 116*c* in the $G_3$ electrode are similarly provided with vertically oriented upper and lower slots. Similarly, as shown for the case of the $G_4$ electrode's center auxiliary aperture 118*b*, each of these auxiliary apertures is provided with generally vertically oriented upper and lower slots 128*a* and 128*b*. Each of the aforementioned auxiliary apertures of the $G_3$ and $G_4$ electrodes includes a generally circular center portion, with the upper and lower slots thereof extending generally vertically, or at 90° relative to the inline alignment of the apertures and associated electron beams. The upper and lower slots in each of the generally circular auxiliary apertures in the $G_3$ and $G_4$ electrodes provide an astigmatism correction as well as balanced focusing for the three electron beams.

The circular center portion of each of the three auxiliary apertures in each of the $G_3$ and $G_4$ electrodes is adapted to receive a cylindrically shaped electrode support rod or mandrel 150 such as shown in dotted-line form for the right-hand apertures in FIG. 6. Electrode support rod 150 has a generally circular cross section with several different diameter dimensions. Electrode support rod 150 extending through the aligned apertures in the $G_3$, $G_2$, $G_3$ and $G_4$ electrodes provides a high degree of concentricity for electron gun 90 during assembly. The smaller apertures 92*c* and 94*c* respectively in the $G_1$ and $G_2$ electrodes requires that this portion of the electrode support rod 150 have a reduced diameter. Prior art approaches employing out-of-round apertures in the electron gun's electrodes to correct for undesirable beam characteristics such as spherical aberration and astigmatism have precluded the use of cylindrically shaped alignment mandrels and have made use of irregularly shaped mandrels which are more expensive to make and more difficult to use in aligning a plurality of apertured electrodes.

Figure 9:
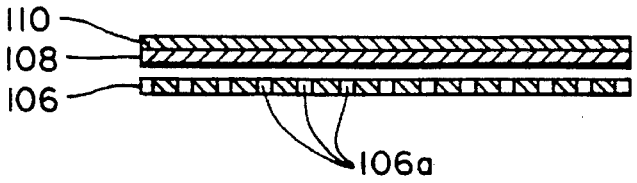
FIG. 9 is a longitudinal sectional view of another embodiment of a bipotential electron gun in accordance with the principles of the present invention.
Figure 9:
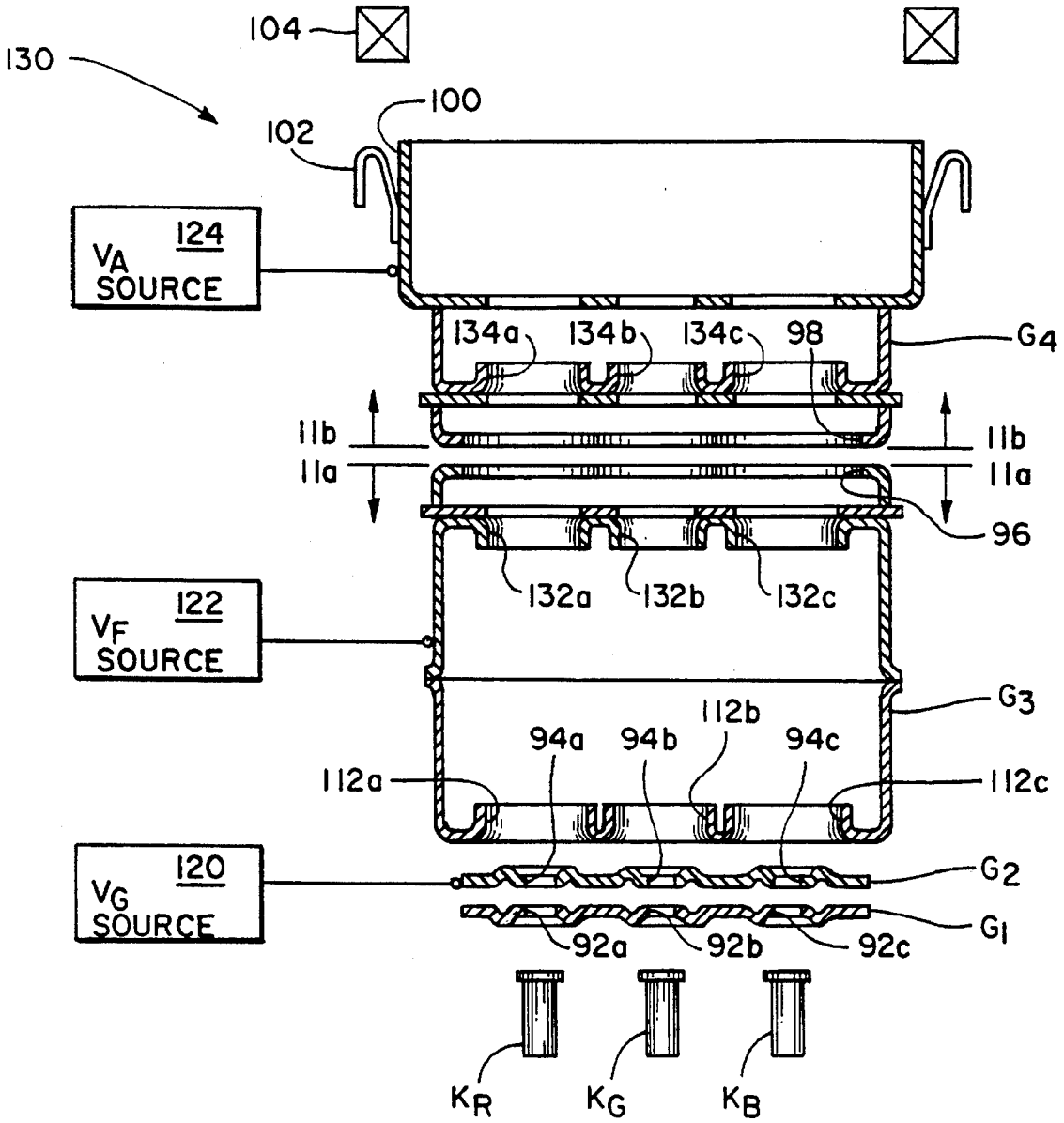
Figure 10:
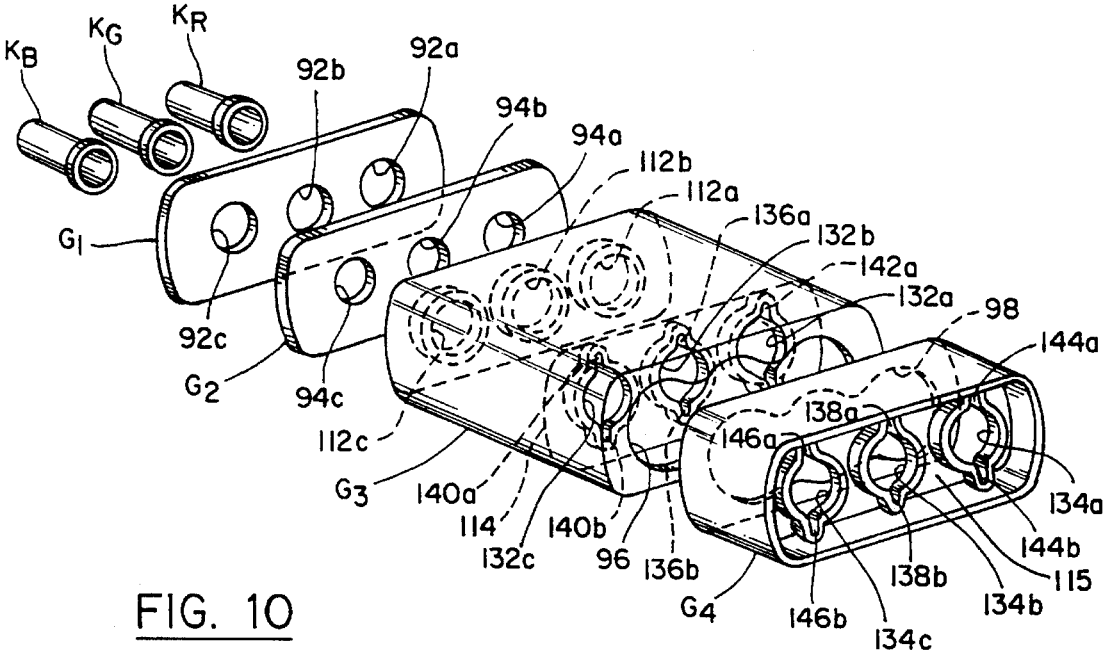
FIG. 10 is a perspective view shown partially in phantom of the electron gun of FIG. 9.
Figure 11A:
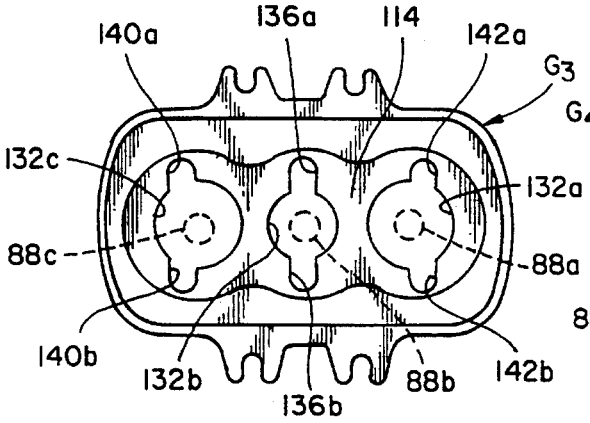
FIGS. 11*a* and 11*b* are sectional views of the electron gun shown in FIG. 9 respectively taken along site lines 11*a*—11*a* and 11*b*—11*b;*
Figure 11B:
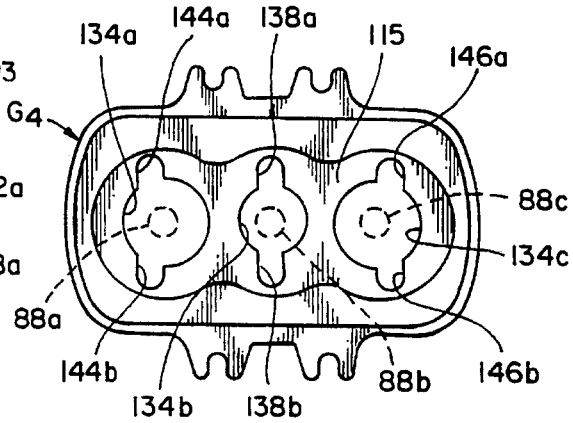

Referring to FIG. 9, there is shown another embodiment of a bipotential electron gun 130 in accordance with the principles of the present invention. Like elements performing substantially the same function in substantially the same manner in electron gun 130 are identified with the same numbers as those used in the embodiment shown in FIG. 6. Thus, the bottom side of the $G_3$ electrode includes three inline circular apertures 112*a*, 112*b* and 112*c*. Similarly, facing portions of the $G_3$ and $G_4$ electrodes are provided with chain-link-shaped, common apertures 96 and 98, respectively. Differences between this embodiment and the embodiment shown in FIGS. 6, 7 and 8*a*, 8*b* are more clearly shown in the perspective view of FIG. 10 and the sectional views of FIGS. 11*a* and 11*b* respectively taken along site lines 11*a*—11*a* and 11*b*—11*b* in FIG. 9. From these figures, it can be seen that the three inline auxiliary apertures 132*a*, 132*b* and 132*c* in the $G_3$ electrode each have a generally circular center portion, with the two outer apertures on respective sides of the center aperture provided with off-centered upper and lower slots. Thus, the two outer inline apertures 132*a* and 132*c* in the $G_3$ electrode include respective upper and lower, generally vertically oriented slots 142*a*, 142*b* and 140*a*, 140*b*, respectively. These slots are disposed outwardly from the center of the aperture for improved astigmatism correction and beam focusing. Similarly, the sectional view of FIG. 11*b* shows that the two outer inline auxiliary apertures 134*a* and 134*c* are respectively provided with pairs of upper and lower slots 144*a*, 144*b* and 146*a*, 146*b* for improved beam astigmatism and defocusing correction. As shown in FIG. 11*a*, electron beams 88*a*, 88*b* and 88*c* (shown in dotted-line form) pass through the respective centers of auxiliary apertures 132*a*, 132*b* and 132*c*. Similarly, FIG. 11*b* shows the three electron beams 88*a*, 88*b* and 88*c* transitting through the respective centers of beam passing auxiliary apertures 134*a*, 134*b* and 134*c* in the $G_4$ electrode.

Also in the embodiment shown in FIGS. 9, 10 and 11*a*, 11*b*, the outer auxiliary apertures 132*a*, 132*c* in the $G_3$ electrode and outer auxiliary apertures 134*a*, 134*c* in the $G_4$ electrode are larger in diameter than the center apertures 132*b* and 134*b*. Moving the upper and lower vertically oriented slots in the two outer auxiliary beam passing apertures in the $G_3$ and $G_4$ electrodes outward and making the two end apertures larger in diameter than the center aperture provides improved beam astigmatism and defocusing correction particularly at high electron beam currents, i.e., $i_C \geqq 2$–3 mA.

Figure 12:
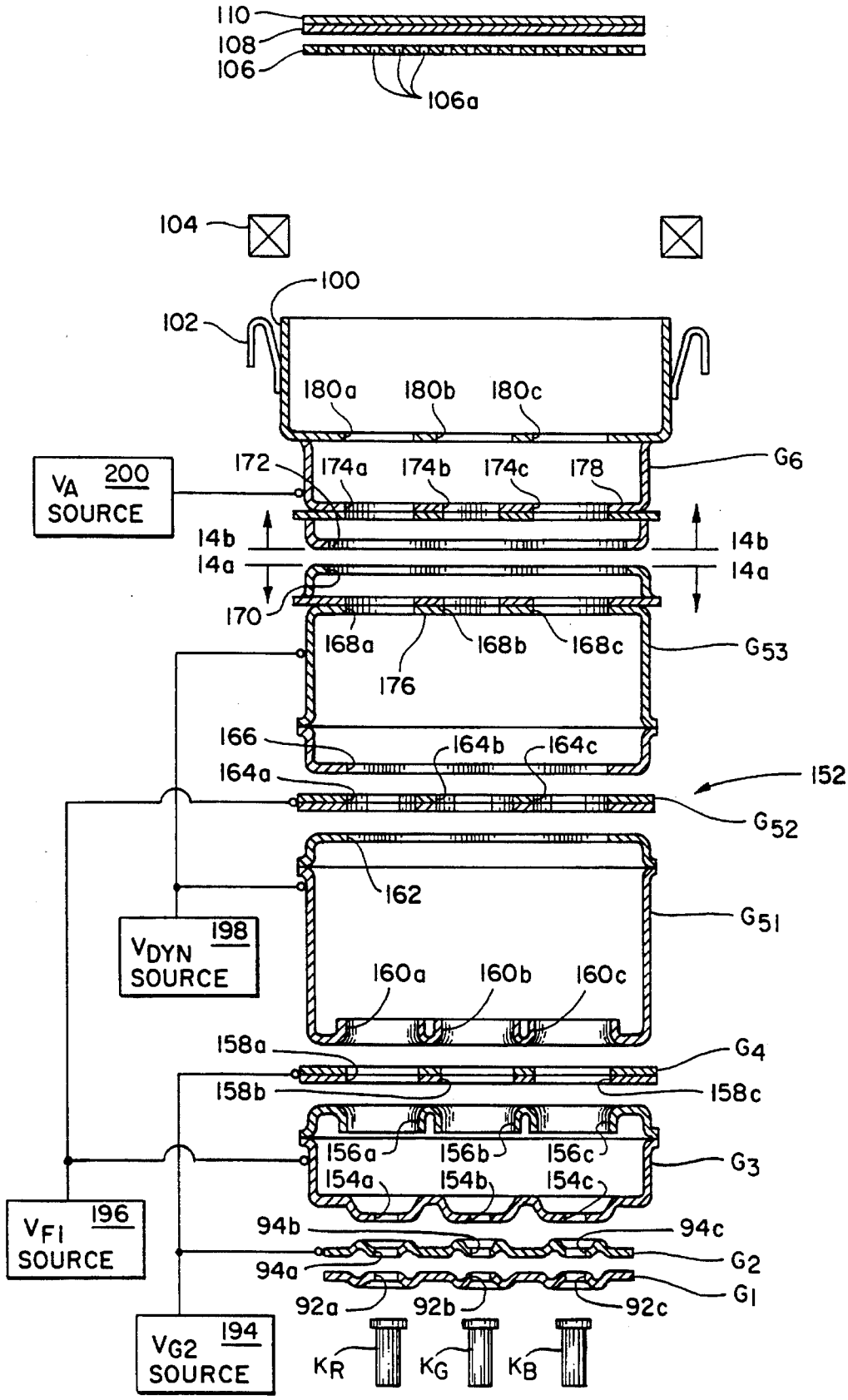
FIG. 12 is a longitudinal sectional view of an electron gun having a dynamic quadrupole lens in accordance with another embodiment of the present invention.

Referring to FIG. 12, there is shown a longitudinal sectional view of yet another embodiment of an electron gun 152 in accordance with the present invention. In the embodiment of FIG. 12, all components identical to those of the previously described embodiments which function in the same way to achieve essentially the same results are identified by the same numbers as those used earlier. Thus, electron gun 152 includes three equally spaced co-planar cathodes $K_R$, $K_G$ and $K_B$. Electron gun 152 further includes a $G_1$ control electrode, a $G_2$ screen electrode and a $G_3$ electrode. The $G_3$ electrode includes three inline apertures 154*a*, 154*b* and 154*c* on its low side and three inline apertures 156*a*, 156*b* and 156*c* on its high side in facing relation with a $G_4$ electrode. The $G_4$ electrode also includes three inline apertures 158*a*, 158*b* and 158*c*, each aligned with a respective pair of lower and upper apertures in the $G_3$ electrode. Electron gun 152 further includes a $G_{51}$ electrode having three inline apertures 160*a*, 160*b* and 160*c* on its low side and a common, elongated aperture 162 on its high side through which all three electron beams pass. A plate-like $G_{52}$ electrode having three inline apertures 164*a*, 164*b* and 164*c* is disposed adjacent the high side of the $G_{51}$ electrode. Electron gun 152 further includes a $G_{53}$ electrode having an elongated common aperture 166 in facing relation with the $G_{52}$ electrode through which all three electron beams pass and a chain-link-shaped common aperture 170 on its high side also through which all three electron beams pass. Disposed within the $G_{53}$ electrode is an inner wall 176 which includes three inline auxiliary apertures 168*a*, 168*b* and 168*c* through each of which a respective one of the electron beams passes. A $G_6$ electrode is disposed adjacent to the $G_{53}$ electrode and also includes a chain-link-shaped common aperture 172 through which all three electron beams pass in facing relation to the chain-link-shaped common aperture 170 in the $G_{53}$ electrode. The $G_6$ electrode also includes an inner panel or wall 178 including three inline auxiliary beam passing apertures 174*a*, 174*b* and 174*c*. A convergence cup 100 also including three inline beam passing apertures 180*a*, 180*b* and 180*c* is attached to the high side of the $G_6$ electrode as in the previously described embodiments.

Various voltages, or potentials, as these terms are used interchangeably herein, are applied to the various electrodes of electron gun 150 as shown in FIG. 12. For example, a fixed $V_{G2}$ voltage is provided to the $G_2$ and $G_4$ electrodes via a $V_{G2}$ source 194. Similarly, a fixed $V_{F1}$ voltage as provided to the $G_3$ and $G_{52}$ electrodes via a $V_{F1}$ source 196. A fixed anode, or accelerating, voltage $V_A$ is provided to the $G_6$ electrode via a $V_A$ source 200. $V_{G2}$ provided to the $G_2$ and $G_4$ electrodes is in the range of about 300 V to 1000 V. $V_{F1}$ is on the order of 7 kV. $V_A$ is the anode potential of about 25 kV. The $G_1$ control electrode, the $G_2$ screen electrode and a facing portion of the $G_3$ electrode comprise a beam forming region (BFR) of electron gun 152. An opposed portion of the $G_3$ electrode, the $G_4$ electrode and a facing portion of the $G_{51}$ electrode comprise a symmetric prefocus lens of electron gun 152. Facing portions of the $G_{53}$ electrode and the $G_6$ electrode form the main focus lens of electron gun 152.

As shown in FIG. 12, the $G_{51}$ and $G_{53}$ electrodes are coupled to and charged by a dynamic voltage ($V_{DYN}$) source 198. While this embodiment of the present invention is described in terms of a dynamic voltage being applied to first and third electrodes with a second electrode disposed therebetween maintained at a fixed voltage, the present invention is equally applicable to applying a dynamic voltage to a electrode disposed intermediate to adjacent electrodes maintained at a fixed voltage. The dynamic focusing voltage $V_{DYN}$ applied to the $G_{51}$ and $G_{53}$ electrodes varies in a periodic manner with electron beam sweep across the CRT's display screen 110. A maximum difference between the $V_{F1}$ voltage applied to the $G_{52}$ electrode and $V_{DYN}$ applied to the $G_{51}$ and $G_{53}$ electrodes occurs at full deflection of the electron beams while a minimum difference between these two voltages occurs when the electron beams are positioned along a vertical center line of display screen 110. The combination of the $G_{51}$, $G_{52}$ and $G_{53}$ electrodes forms a dynamic quadrupole lens for the purpose of correcting for electron beam astigmatism.

Figure 13:
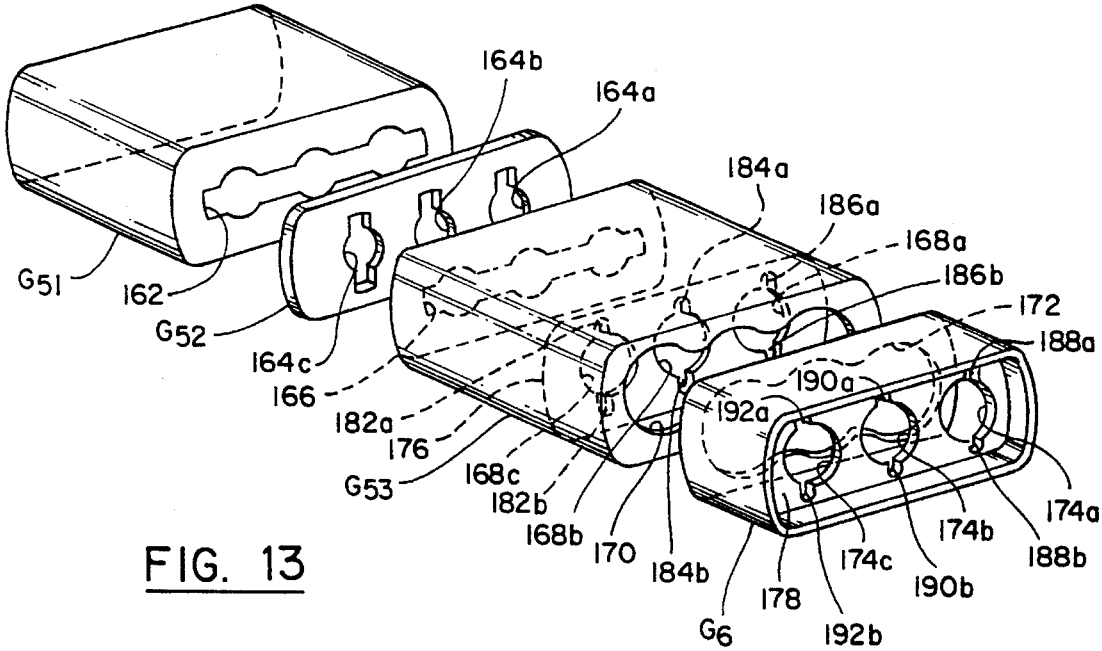
FIG. 13 is a perspective view shown partially in phantom of a portion of the electron gun of FIG. 12.
Figure 14A:
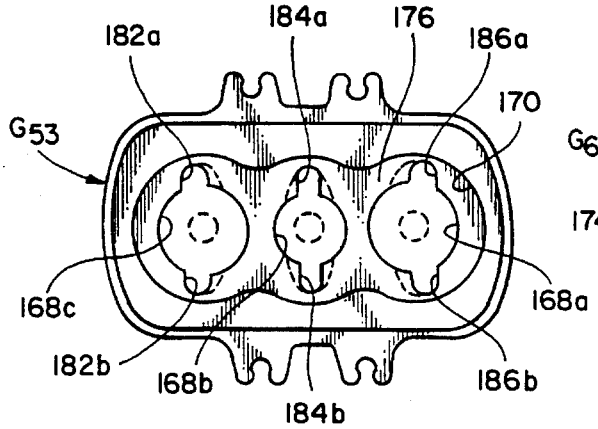
FIGS. 14*a* and 14*b* are sectional views of the electron gun of FIG. 12 respectively taken along site lines 14*a*—14*a* and 14*b*—14*b* therein.
Figure 14B:
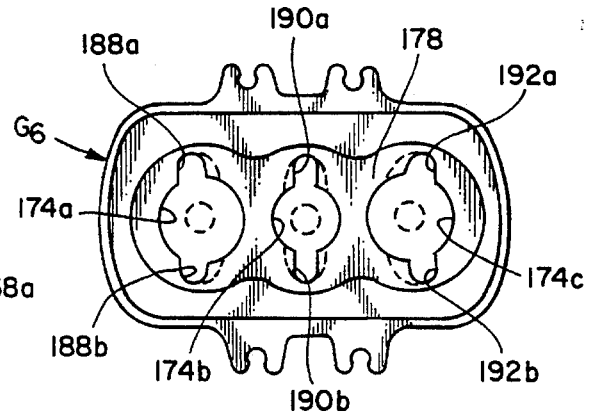

Referring to the perspective view of a portion of the electron gun of FIG. 13 as well as to the sectional views of FIGS. 14*a* and 14*b* of the electron gun 152 shown in FIG. 12 respectively taken along site lines 14*a*—14*a* and 14*b*—14*b*, additional details of the inventive electron gun will now be described. Each of the three auxiliary apertures in the $G_{53}$ and $G_6$ electrodes is provided with upper and lower, generally vertically extending slots. Thus, as shown in FIG. 14*a* for the case of the $G_{53}$ electrode, center electron beam passing auxiliary aperture 168*b* includes upper and lower slots 184*a* and 184*b*. Similarly, the outer beam passing auxiliary apertures 168*a* and 168*c* include respective pairs of upper and lower slots 186*a*, 186*b* and 182*a*, 182*b*. Similarly, as shown in FIG. 14*b*, the center beam passing auxiliary aperture 174*b* of the $G_6$ electrode includes upper and lower generally vertically extending slots 190*a* and 190*b*. Outer electron beam passing auxiliary apertures 174*a* and 174*b* similarly include respective upper and lower slots 188*a*, 188*b* and 192*a*, 192*b*. As in the previously described embodiment, each pair of upper and lower slots in the outer auxiliary beam passing apertures is off-center and displaced slightly outwardly from the center of the aperture. Thus, upper and lower pairs of slots 182*a*, 182*b* and 186*a*, 186*b* are displaced outwardly from the respective centers of outer beam passing auxiliary apertures 168*c* and 168*a*. A similar arrangement is shown for the case of the two outer auxiliary beam passing apertures 174*a*, 174*c* in the $G_6$ electrode of FIG. 14*b*. Also as in the previously described embodiment, the two outer auxiliary beam passing apertures 168*a*, 168*c* are larger in diameter than the center auxiliary beam passing aperture 168*b* in the $G_{53}$ electrode. Similarly, the two outer auxiliary beam passing apertures 174*a*, 174*c* of the $G_6$ electrode are larger in diameter than the center auxiliary beam passing aperture 174*b*.

The present invention is not limited to the use of thin linear slots extending vertically from and centered on a respective beam passing auxiliary aperture. Thus, for example, as shown in dotted-line form in FIGS. 14*a* and 14*b*, outer pairs of electron beam passing auxiliary apertures 168*a*, 168*c* and 174*a*, 174*c* may be provided with unsymmetrical upper and lower slots which may have an inwardly directed "bulging" portion as shown in the figures. Similarly, the center beam passing auxiliary apertures 168*b* and 174*b* may be provided with curvilinear upper and lower slots having wider proximal than distal end portions. Thus, the upper and lower slots of each of the three inline auxiliary beam passing apertures in the $G_{53}$ and $G_6$ electrodes may assume virtually any shape so long as they provide vertically extending portions on upper and lower sections of each aperture. Also it should be pointed out that while the three auxiliary inline beam passing apertures in the $G_3$ and $G_4$ electrodes in the previously described embodiments are shown as formed from an extruded inner wall in the electrode, the three auxiliary inline beam passing apertures of the $G_{53}$ and $G_6$ electrodes of the embodiment shown in FIGS. 12, 13 and 14*a*, 14*b* are not formed by means of an extrusion, but are merely formed as apertures in a flat inner wall in the electrode.

There has thus been shown a main lens for use in a multi-beam inline electron gun which includes a pair of adjacent electrodes each including a horizontally elongated common aperture for passing the electron beams, where the common apertures are in facing relation, and three inline auxiliary beam passing apertures. The three inline auxiliary beam passing apertures in each of the electrodes each have a center round portion from which a pair of upper and lower elongated slots extend. The center round portions of the apertures are adapted to receive a cylindrical electrode support rod, or mandrel, to ensure electrode concentricity and alignment during electron gun assembly. The elongated upper and lower slots disposed in each auxiliary beam passing aperture provide beam astigmatism and defocusing correction. The three inline auxiliary apertures may have the same diameter, or the two outer beam passing apertures may be provided with larger diameters and wider slots than the center aperture in another embodiment. Each pair of vertically extending upper and lower slots may be vertically centered on the aperture, or the two outer apertures may have outwardly disposed upper and lower slots in another embodiment. The slots may be generally linear and defined by a pair of spaced parallel vertical edges or they may be unsymmetrical and have a proximal end of increased width.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An electrode in an electron gun for directing a center and two outer inline electron beams along respective parallel axes onto a display screen of a color cathode ray tube (CRT) in forming a video image on said screen, said electrode comprising:

a hollow housing open at a first end and including means disposed on a second, opposed end thereof for defining three inline end apertures at a second opposed end and a thin lateral wall forming side portions of said housing, wherein each of said inline end apertures is aligned with a respective one of said axes for passing a respective one of said beams and wherein said first open end includes a single common aperture having a longitudinal axis aligned generally transverse to said inline electron beams for passing said center and two outer electron beams;

wall means disposed in said hollow housing for defining circular portions of three inline auxiliary apertures disposed intermediate said first and second ends of said housing, wherein each of said auxiliary apertures is aligned with a respective one of said axes for passing a respective one of said beams and wherein said circular portions of each of said auxiliary apertures are adapted to receive in tight-fitting engagement an elongated support rod having a generally circular cross section for aligning the electrode during electron gun assembly, and wherein said wall means and said first and second ends of said hollow housing are maintained at the same fixed voltage; and an upper and lower pair of slots disposed in each of said auxiliary apertures and aligned generally transverse to said longitudinal axis for providing a static correction for electron beam astigmatism, wherein said static correction is of substantially fixed magnitude over the entire display screen.

2. The electrode of claim 1 wherein each of said upper and lower slots in each of said auxiliary apertures are diametrically disposed in a respective aperture and wherein each slot is defined by a pair of spaced, generally vertical linear edges and a distal curvilinear end edge.

3. The electrode of claim 1 wherein said wall means defining said circular portions of said auxiliary apertures and forming said pair of slots in said apertures includes an inner wall in said housing extending inwardly from said lateral wall.

4. The electrode of claim 3 wherein said wall means defining said circular portions of said auxiliary apertures and forming said pair of slots in each of said apertures further includes a plurality of extrusions in said inner wall disposed about a respective aperture.

5. The electrode of claim 1 wherein said auxiliary apertures include a center aperture and two outer apertures each disposed on a respective opposed side of said center aperture, and wherein said upper and lower slots are diametrically disposed in said center aperture and said upper and lower slots are disposed on respective opposed outer portions of said two outer apertures.

6. The electrode of claim 5 wherein said wall means defining said circular portions of said auxiliary apertures and forming said pair of slots in each of said apertures includes an inner wall in said housing extending inwardly from said lateral wall.

7. The electrode of claim 6 wherein said wall means defining said circular portions of said inner apertures and forming said pair of slots in each of said apertures further includes a plurality of extrusions each disposed about a respective aperture.

8. The electrode of claim 1 wherein said common aperture is generally chain-link-shaped having a center enlarged portion and first and second outer enlarged portions each aligned with a respective axis for passing said center and two outer electron beams, respectively.

9. The electrode of claim 1 wherein said electrode is a $G_3$ or $G_4$ electrode in a bipotential electron gun.

10. The electrode of claim 1 wherein said electrode is a $G_5$ electrode forming a portion of a dynamic quadrupole in the electron gun.

11. The electrode of claim 1 including a center and two outer inline auxiliary apertures, wherein the circular portions of said two outer auxiliary apertures are larger than the circular portion of said center auxiliary aperture.

12. For use in a color cathode ray tube (CRT) having a center and two outer inline electron beams, wherein said electron beams are deflected across a display screen in the CRT in a synchronous manner by a magnetic deflection yoke, an electron gun comprising:

cathode means for generating electrons;

beam forming means for receiving said electrons and forming said electrons into three inline beams, including said center beam and said two outer beams;

first and second electrode means arranged in a spaced manner along said electron beams for applying an electrostatic focus field to the electron beams, wherein each of said electrode means includes a hollow housing having a peripheral side wall and first and second end portions and means disposed on the first end portion thereof for defining an elongated common end aperture with a longitudinal axis aligned generally transverse to said inline electron beams and through which said electron beams pass, wherein said common apertures of said first and second electrode means are arranged in facing relationship; and an inner wall disposed in each hollow housing of each of said first and second electrode means and including a center and two outer inline auxiliary apertures for passing a respective electron beam, wherein each inner wall is disposed intermediate the first and second end portions of its associated electrode means and wherein said inner wall is maintained at the same fixed voltage of the first and second end portions of its associated electrode means; and wherein each of said auxiliary apertures includes a center circular portion and upper and lower slots extending from said circular portion and aligned generally transverse to a longitudinal axis of a common end aperture for providing a static correction for electron beam astigmatism, wherein said static correction is of substantially fixed magnitude over the entire display screen.

13. The electron gun of claim 12 wherein said first and second electrode means are respectively $G_3$ and $G_4$ electrodes in a bipotential electron gun.

14. The electron gun of claim 12 wherein said first and second electrode means form a portion of a dynamic quadrupole in the electron gun.

15. The electron gun of claim 12 wherein each of said upper and lower slots in each of said auxiliary apertures are diametrically disposed on a respective aperture.

16. The electron gun of claim 12 wherein said inner wall in each of said housings extends inwardly from the peripheral side wall of said housing.

17. The electron gun of claim 16 wherein each of said inner walls includes a plurality of extrusions disposed about a respective aperture.

18. The electron gun of claim 12 wherein said auxiliary apertures include a center aperture and two outer apertures each disposed on a respective opposed side of said center aperture, and wherein said upper and lower slots are diametrically disposed on said center aperture and said upper and lower slots are disposed on respective opposed outer portions of said two outer apertures.

19. The electron gun of claim 12 wherein each of said common end apertures is generally chain-link-shaped having a center enlarged portion and first and second outer enlarged portions each aligned with a respective axis for passing said center and two outer electron beams, respectively.

20. The electron gun of claim 12 wherein the circular portions of said outer auxiliary apertures are larger than the circular portion of said center auxiliary apertures.

* * * * *

UNITED STATES PATENT AND TRADEMARK OFFICE

CERTIFICATE OF CORRECTION

PATENT NO. : 5,488,265
DATED : January 30, 1996
INVENTOR(S) : Hsing-Yao Chen

It is certified that error appears in the above-indentified patent and that said Letters Patent is hereby corrected as shown below:

Column 10, line 54, after the word at, "a" should be deleted and--"said" inserted--.

Signed and Sealed this

Second Day of July, 1996

Bruce Lehman

*Attest:*

BRUCE LEHMAN

*Attesting Officer*

*Commissioner of Patents and Trademarks*